US008070666B2

(12) United States Patent
Rochat

(10) Patent No.: US 8,070,666 B2
(45) Date of Patent: Dec. 6, 2011

(54) DISPOSABLE DEVICE FOR CENTRIFUGATION OF BLOOD

(76) Inventor: Jean-Denis Rochat, Genolier (CH)

( * ) Notice: Subject to any disclaimer, the term of this patent is extended or adjusted under 35 U.S.C. 154(b) by 788 days.

(21) Appl. No.: 12/158,119

(22) PCT Filed: Dec. 14, 2006

(86) PCT No.: PCT/CH2006/000701

§ 371 (c)(1),
(2), (4) Date: Jun. 19, 2008

(87) PCT Pub. No.: WO2007/071086

PCT Pub. Date: Jun. 28, 2007

(65) Prior Publication Data

US 2008/0264841 A1 Oct. 30, 2008

(30) Foreign Application Priority Data

Dec. 21, 2005 (EP) ..... 05405717

(51) Int. Cl.
*B04B 11/08* (2006.01)

(52) U.S. Cl. ..... 494/41; 494/26; 494/36; 494/38

(58) Field of Classification Search ..... 494/41, 494/43, 38, 56, 36, 12, 23–30, 83–85
See application file for complete search history.

(56) References Cited

U.S. PATENT DOCUMENTS

| | | | | |
|---|---|---|---|---|
| 3,073,517 | A * | 1/1963 | Pickels et al. | 494/67 |
| 3,601,307 | A * | 8/1971 | Shapiro | 494/15 |
| 3,616,992 | A | 11/1971 | Deacon | |
| 4,417,885 | A | 11/1983 | Kohlstette et al. | |
| 5,045,048 | A * | 9/1991 | Kaleskas et al. | 494/41 |
| 5,312,319 | A * | 5/1994 | Salter | 494/12 |
| 5,505,683 | A * | 4/1996 | Geringer et al. | 494/12 |
| 5,514,070 | A * | 5/1996 | Pages | 494/41 |
| 5,851,169 | A | 12/1998 | Meresz et al. | |
| 5,885,202 | A * | 3/1999 | Ostkamp | 494/25 |
| 7,717,274 | B2 * | 5/2010 | Kao et al. | 210/512.1 |
| 2008/0132397 | A1 * | 6/2008 | Rochat | 494/45 |
| 2008/0264841 | A1 * | 10/2008 | Rochat | 210/120 |

FOREIGN PATENT DOCUMENTS

JP 09192215 A * 7/1997

OTHER PUBLICATIONS

International Search Report of PCT/CH2006/000701, date of mailing Mar. 21, 2007.

Written Opinion of the International Searching Authority (Form PCT/IB/373) of International Application No. PCT/CH2006/000701 having a International filing date of Dec. 14, 2006 with translation forms PCT/ISA/237.

* cited by examiner

*Primary Examiner* — Charles E Cooley

(74) *Attorney, Agent, or Firm* — Westerman, Hattori, Daniels & Adrian, LLP

(57) ABSTRACT

A disposable device for centrifugation of blood is used for separating or also washing constituents of the blood includes a centrifugation chamber with a revolving shaft and an opening through which the shaft passes, a rotational guide, a rotational driver, and at least one static member for admission/evacuation engaged in the centrifugation chamber. This member includes at least one channel for intake of the blood and at least one outlet channel for one of its constituents, and at least one admission channel for a pressurized gaseous fluid which opens out inside the centrifugation chamber. A gap is formed in the opening between the centrifugation chamber and the static member and allows the gaseous fluid to escape from the centrifugation chamber.

21 Claims, 3 Drawing Sheets

DISPOSABLE DEVICE FOR CENTRIFUGATION OF BLOOD

BACKGROUND ART

The present invention relates to a disposable device for centrifugation of blood, which is used to separate or also wash constituents of the blood. Such blood can be whole blood, for example, or blood from which the leukocytes have already been removed by filtration, or blood flowing from an operating site.

Centrifugation is the most commonly used technique for separating blood constituents, such as red blood cells, plasma, white blood cells and platelets, from blood originating directly from the donor, from a collection bag, from an operating site or from a blood sample. This is done using separators that are composed of a centrifugation chamber driven in rotation about a vertical shaft by a motor capable of turning at high speed, generally between 1,000 and 50,000 rpm. The blood is introduced continuously or non-continuously into the centrifugation chamber by way of an inlet channel that forms part of a fixed axial member of the centrifugation device.

Under the effect of the centrifugal force, the various constituents of the blood separate on account of their different densities. This separation takes place naturally in a predefined order, such that the blood constituent of greater density, namely the red blood cells, is always positioned at the greatest possible distance from the axis of revolution, whereas the constituent of lower density will always be situated nearer this axis than all the other constituents. By means of this separation in distinct layers, these constituents can be extracted separately by collectors that extend respectively into the stratification zones. In this way, each blood constituent is conveyed separately to an outlet channel situated in the fixed axial member of the device. Once they have been extracted from the centrifugation chamber via these outlet channels, they can be collected in separate bags or re-injected into the patient.

Such a device is described in more detail in patent application EP 05405037. When it is intended to be used in non-sterile environments, for example in blood transfusion centers or in a hospital environment, it is imperative to be able to guarantee the sterility of all the volumes through which the blood and its constituents will pass. To meet this requirement, the separation kits are made ready in a sterile package and are designed in such a way as to define a closed space that is hermetically sealed off to entry of any gas or fluid other than blood. To this end, the various bags for collecting the blood products are generally pre-connected to the separation kit.

The sterility of this assembly would not be complete unless a means was provided to ensure non-contamination of the centrifugation chamber at the place where the fixed and movable parts join, namely between the axial member for admission/evacuation and the centrifugation chamber. This means must satisfy two main criteria, namely that of guaranteeing the sterility of the centrifugation device, and also that of permitting high speeds of rotation of the centrifugation chamber while minimizing the heating between the fixed and movable parts of the device. This latter criterion is aimed at preventing heating of the blood by conduction within this device. The reason is that it is imperative to keep the blood at a temperature below 40° C. in order to avoid degradation of its constituents.

In an attempt to satisfy these criteria, various systems have been used, of which one example is the device described in document U.S. Pat. No. 3,586,413 and known to a person skilled in the art by the term "lasso". This system involves the provision of a flexible tube, of which one end is integrally connected to the center of the centrifugation chamber, and of which the other end is integrally connected to a fixed part of the device. The two ends of this tube give it the shape of a half loop that is rotated about the centrifugation chamber at a speed equal to half that of the chamber. This system allows a connection to be created between the tube and the centrifugation chamber without friction and without any heating other than that arising from the bending and twisting forces of the flexible tube as it rotates about itself. The main disadvantages of this device are that it is of complex construction, it involves awkward rotation of a tube about the centrifugation chamber, and this tube is subjected to a substantial tensile stress generated by the centrifugal force to which it is subjected.

Document U.S. Pat. No. 5,045,048 describes another device, which is much simpler to produce than the preceding one, and in which the junction between the fixed admission/evacuation conduits and the rotatable chamber is formed by a pair of components that between them have a very low coefficient of friction. The first component forms part of the fixed kit and, in order to guarantee the leaktightness of the connection, it bears against the second component, which is integrally connected to the centrifugation chamber. This coupling of the components can be effected by means of a V-ring made of polymer, turning on a metal washer, or can be formed by a ceramic ring bearing on a graphite ring. Although this system has the advantages of low production costs and of being simple to use, it nevertheless has the disadvantage of limiting the maximum speed of rotation of the chamber, because of the heating induced in the components rubbing against each other.

In order to reduce this heating, consideration has also been given to the idea of adding a plurality of ventilation fins arranged near the surface of friction of the two components rubbing against each other. The provision of such a ventilated joint inside a centrifugation device does indeed contribute to improving the dissipation of heat emanating from these components, but without being entirely satisfactory. Such a device is described in more detail in document EP 619,145.

In patent application EP 05,405,037, the leaktightness between the fixed and movable parts of the centrifugation device is effected by means of a tubular joint. One of the ends of this joint is fixed on a cylindrical portion of the fixed axial member, while the other end is introduced into an annular space of the neck of the centrifugation chamber, bearing against a convex surface of this neck. By virtue of this bearing, the tubular joint undergoes radial deformation which ensures the leaktightness of the centrifugation chamber. Although the diameter of the neck of the centrifugation chamber against which this joint rubs is a small diameter, the fact remains that heating is caused directly as a function of the speed of rotation of the chamber. With this system, the maximum speed of rotation is limited because of this heating. In addition, using chambers provided with a neck of greater diameter would again render unsatisfactory the use of this tubular joint for solving said problem of heating.

SUMMARY OF THE INVENTION

It is an object of the present invention to remedy at least some of the aforementioned disadvantages by proposing a disposable device for centrifugation of blood which, on the one hand, can ensure sterility of all of the internal volumes of this device that are in contact with the blood, and, on the other hand, can eliminate any heating resulting from the rotation of this chamber about the static member for admission/evacuation arranged on the axis of revolution of the chamber.

Another object of the present invention is to produce a centrifugation device that is also economical. The reason for this is that, in the field of handling or transfer of blood, it is not uncommon for the equipment employed to be disposed of after its first use. Although being perfectly operational from the point of view of its function, such a centrifugation device will be intended for a single application for reasons that are known and that are aimed at preventing any risk of blood contamination. It is therefore advantageous for the disposable devices to be designed as simply as possible, while meeting the criteria demanded in terms of sterility and efficacy.

The first advantage of this device lies in the fact that it eliminates any possibility of a rise in the temperature of the blood or of its constituents. For this reason, the quality of the blood and of its constituents is guaranteed since it is not changed. In addition, and by virtue of the subject matter of the present invention, the speed of rotation of the centrifugation chamber is no longer dependent on the means ensuring sterility of the device with respect to a non-sterile external environment. Advantageously, the higher this speed, the shorter the dwell time of the blood in the chamber for obtaining separation of its constituents. For this reason, the flow rate of treated blood will be usefully increased, and the efficacy of the device will also be improved.

BRIEF DESCRIPTION OF THE DRAWINGS

Other advantages will become evident from the following description of a preferred embodiment of the subject matter of the present invention, said embodiment being given as a non-limiting example and being depicted in the attached figures, in which.

DETAILED DESCRIPTION OF PARTICULAR EMBODIMENTS

Figure 1:
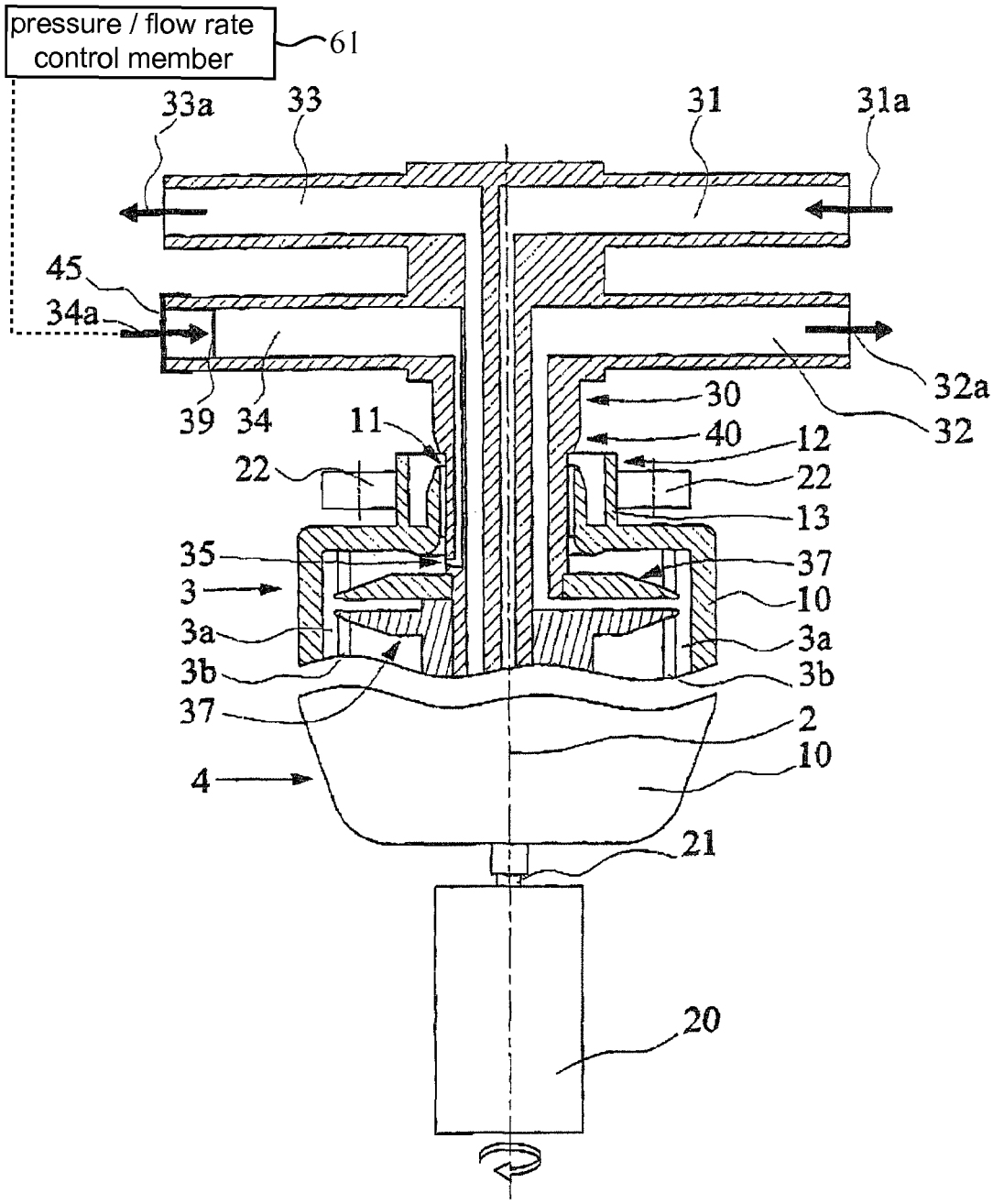
FIG. 1 is a schematic view, in a vertical partial cross section, of the device of the present invention, represented in what is called an open position.

Referring to FIG. 1, the disposable device of the present invention comprises a centrifugation chamber 10 with a preferably vertical axis of revolution 2. This axis of revolution extends through an opening 11 formed in the upper part 3 of the centrifugation chamber. The latter is rotated about its axis of revolution by drive means 20, such as an electric motor whose rotation shaft 21 is connected integrally to the lower part 4 of the centrifugation chamber.

This chamber is positioned, guided and held in rotation by guide means 22 that are preferably arranged in its upper part 3 in such a way as to engage with the latter. These means can be made up, for example, of three centering rollers that engage with a tread 13 and are arranged at 120° around the axis of revolution 2 of the chamber. They can advantageously be mounted so as to be retractable, for example at the end of a pivoting arm or of a telescopic arm. As is illustrated in the figures, the tread 13 will preferably be part of the neck 12 of the centrifugation chamber and will be formed by an external surface that is perfectly circular and concentric to the axis of revolution 2. To take into account a possible eccentricity of the centrifugation chamber, at least one centering roller could advantageously be mounted on an elastic suspension. Such an arrangement could be formed, for example, by placing a roller at the end of an arm mounted so as to pivot under the action of a restoring spring, so as to guarantee permanent contact of the roller against the tread 13.

The opening 11 of the centrifugation chamber 10 is traversed by at least one static member 30 for admission/evacuation of blood and of at least one of the constituents thereof. The term static attributed to this member 30 is simply intended to signify that it is not driven in rotation, unlike the centrifugation chamber. It will thus be appreciated that the device of the present invention comprises a part which is movable in rotation and through whose opening there is engaged at least one part that is not movable in rotation. These parts can be fixed or preferably movable relative to each other in translation along the axis of revolution 2, as will be seen hereinafter.

The static member 30 for admission/evacuation is engaged in the centrifugation chamber 10 via the opening 11 thereof, such that a portion of this member is situated inside the centrifugation chamber 10, while another portion is outside the latter. This member comprises at least one inlet channel 31 for the blood issuing for example from a bag (not shown) for collecting a defined volume of blood. Alternatively, it would also be possible to treat blood directly from a donor via flexible conduits joined to the outer end of this channel, or, in the case of autotransfusion, to treat blood flowing from an operating site. In the direction indicated by the arrow 31*a*, the blood flows continuously, or intermittently, from the outside to the inside of the centrifugation chamber. The static member also comprises at least one outlet channel 32 for a constituent of the blood. The flow of this constituent takes place from the inside to the outside of the chamber, according to the arrow 32*a*. Such a constituent will be composed, for example, of a concentrate of red blood cells. The outlet channel 33 is a third channel which is preferably arranged within the static member 30 and which is used to extract a second constituent of the blood, for example platelet-rich plasma. The direction of flow of this second blood constituent is indicated in the illustration by the arrow 33*a*.

In the case of autotransfusion, an additional channel (not shown in FIG. 1) can be added in order to introduce into the centrifugation chamber 10 a solution for washing the blood, for example a saline solution. This solution will be mixed with the blood in the chamber 10, then, by virtue of the centrifugal forces, will be separated from the red blood cells and will carry off the impurities contained in the collected blood before being extracted with the plasma via the outlet channel 33.

The ends of the outlet channels 32, 33 are intended to be connected to flexible bags (not shown) for collecting blood constituents. In the case of autotransfusion, these outlets are connected to a means for re-injecting the washed constituent into the patient and, respectively, to a bag containing the waste material from washing. It goes without saying that the connections between these bags and the channels of the centrifugation device are hermetic and are produced under the required sterility conditions. In general, these connections are established in advance, after manufacture of the centrifugation device, in such a way that this assembly can be made ready in a preferably hermetically sealed and sterile package with a view to being sold. However, such a package can also be porous in order to permit subsequent sterilization by steam or gas, before the device is used.

According to the present invention, the static member 30 also comprises at least one admission channel 34 which is provided for a pressurized gaseous fluid and which opens out inside the centrifugation chamber, preferably in the upper part 3 thereof. This fluid can be pre-sterilized air issuing from a source that allows at least this gas to be delivered at a defined pressure, advantageously at an adjustable flow rate. The gaseous fluid enters the admission channel 34, in accordance with the direction of flow indicated by the arrow 34*a*, before emerging at the mouth 35 of this channel and passing into the centrifugation chamber, preferably slightly below the neck 12 of the latter.

Although not necessary to an understanding of the subject matter of the present invention, it will be noted here that, below this mouth 35, the static member 30 for admission/evacuation comprises a plurality of collectors 37 for capturing the blood constituents. These collectors extend radially to reach the different zones of stratification 3*a*, 3*b* of these constituents. By these routes, the constituents can be extracted simultaneously or in succession from the centrifugation chamber via the outlet channels 32, 33 of the static member 30. According to the illustration given in FIGS. 1 and 3, the zone 3*a* is where the red blood cells of higher density than the plasma gather, while said plasma will be situated in the zone 3*b*, nearer to the axis of revolution 2 than the preceding one. This distribution takes place naturally under the effect of the centrifugal force applied to the blood introduced into the centrifugation chamber. In these figures, only the collectors 37 for capturing the red blood cells have been shown. Similar collectors will also be used to capture the plasma or the waste material from washing. Since these collectors are situated below the preceding ones, they do not appear in the depictions illustrated in the figures appended to the present description.

Figure 2:
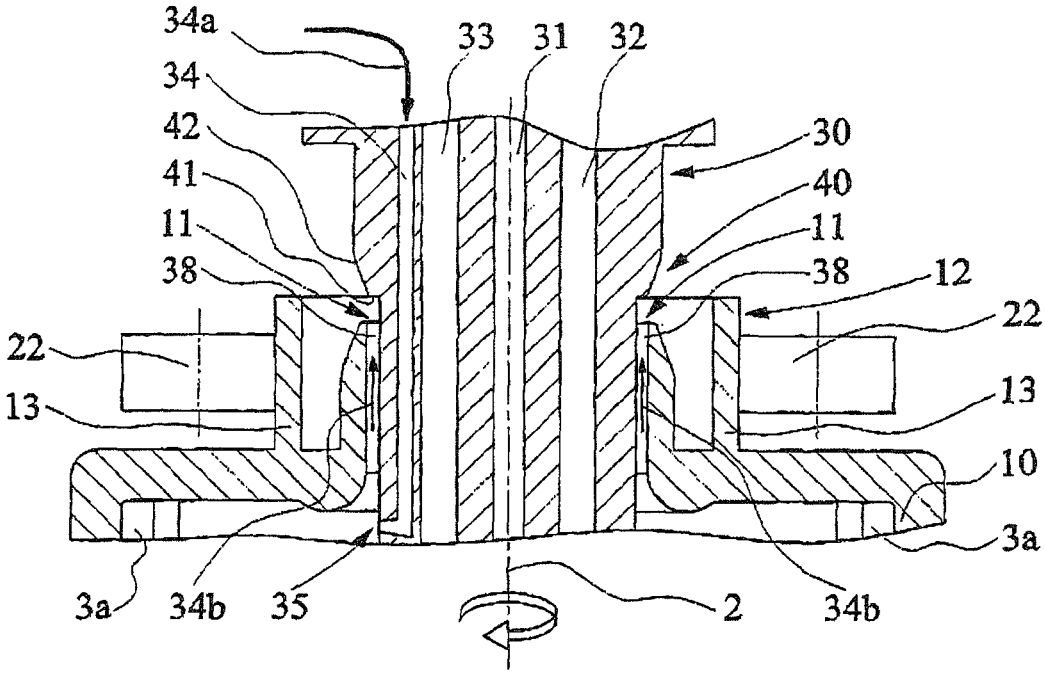
FIG. 2 is a detail of part of the centrifugation chamber shown schematically in FIG. 1.

Referring to FIG. 2, the latter is a schematic and enlarged representation of the central part of the device of the present invention. More precisely, this figure shows a detail of an embodiment of the neck 12 of the centrifugation chamber in which the static member 30 for admission/evacuation is engaged. The device is illustrated here in an open position, which corresponds to the position in which it is located when in operation.

As will be readily seen from this figure, a gap 38 is formed in the opening 11 of the chamber, between said chamber and the static member 30 for admission/evacuation. The purpose of this gap is to form an escape path for the gaseous fluid introduced under pressure into the centrifugation chamber. From the admission channel 34, this gaseous fluid arrives in the chamber by way of the mouth 35. It fills the space available in this chamber and thus pressurizes the latter. The pressure results from the head loss created by the flow rate passing the gap 38. The latter will thus be dimensioned in such a way as to generate a measurable and sufficient overpressure in the centrifugation chamber. By virtue of this calibrated gap, the gaseous fluid escapes from this chamber in a controlled manner as a continuous flow, in accordance with the direction indicated by the arrow 34*b*.

The main function fulfilled by this gaseous flow is to repel any infiltration of microbes, thereby protecting the centrifugation chamber and its contents from any contamination via the escape of gas through the gap 38. This function has the effect of a barrier against infiltration of microorganisms into the device. Advantageously, no rise in the temperature of the blood or of its constituents will be noted. This is in light of the fact that there is no longer any contact between the static member 30 and the centrifugation chamber 10 moveable in rotation. Another advantage is that the arrangement of this gap guarantees the absence of any wear between the rotating part and the non-rotating part of the device of the present invention. According to the preferred embodiment, steps will be taken to ensure that, in the vicinity of the neck, the opening 11 and the static member 30 are circular and concentric to the axis of revolution 2, in such a way that the distribution of the gas flow via the gap 38 can be as homogeneous as possible.

If necessary, the admission channel 34 can be provided with at least one disposable filter 39 for sterilizing the gaseous fluid, as will be clearly seen in FIG. 1. The provision of such a filter can have the aim of guaranteeing the sterility of the gaseous fluid so as not to contaminate the blood or its constituents. Such a filter can also usefully serve as a sterile barrier preventing any microorganism from penetrating into the admission channel 34 when there is no other means closing it upstream. Advantageously, it also makes it possible to guarantee the satisfactory state of the means for filtering the fluid, since it is part of the disposable device of the present invention. As for the fluid used, this can either be a sterile gas, or a gas pre-filtered at source, or a gas intended to be purified by one or more filters 39 arranged in the upstream part of the admission channel 34. It should also be noted that filter is understood as meaning any conventional device that allows the fluid leaving it to destroy, inactivate, trap or reduce the microorganisms it contains to a sterility level that complies with the standards imposed in the field of transfusions and other handling of blood.

According to another feature of the invention, the device is provided with a means 40 for hermetic closure of the gap 38. Such a closure means can be formed by a shoulder 41 and/or by a bearing surface 42, of cylindrical or rounded conical shape, that can engage in the opening 11 of the centrifugation chamber or around the neck 12, more specifically can be fitted by clamping against this neck, for example in the gap 38, by translation of one or other of the parts of the device that are movable and non-movable in rotation. The hermetic closure of this means against the opening formed in the neck of the centrifugation chamber could, if necessary, be improved by provision of an O-ring seal (not shown) joined integrally either to the static member 30 or to the neck 12 of the centrifugation chamber.

In combination with this feature, provision is also made that the centrifugation chamber 10 and/or the static member 30 for admission/evacuation can, on the one hand, slide along the axis of revolution 2, between a position of closure of the gap 38 and a position of opening of said gap, and, on the other hand, can maintain themselves in this opening position by virtue of a means for automatically opening the gap 38. According to a first embodiment, such a means for opening the gap 38 can be formed by the pressure exerted by the gaseous fluid on the closure means 40, more particularly on the shoulder 41. When the device is in its initial configuration, in which it is closed by the engagement of the static member 30 in the neck 12 of the centrifugation chamber, this opening means will make it possible to obtain automatic clearance of the gap 38 upon admission of the gaseous fluid into the centrifugation chamber. This is because the overpressure in the chamber will make it possible to force the chamber 10 sufficiently downward, in the case where the static member 30 is held fixed along the axis of revolution 2, or to force the static member 30 upward, in the reverse case where it is the centrifugation chamber that is held fixed along its axis of revolution.

Figure 2A:
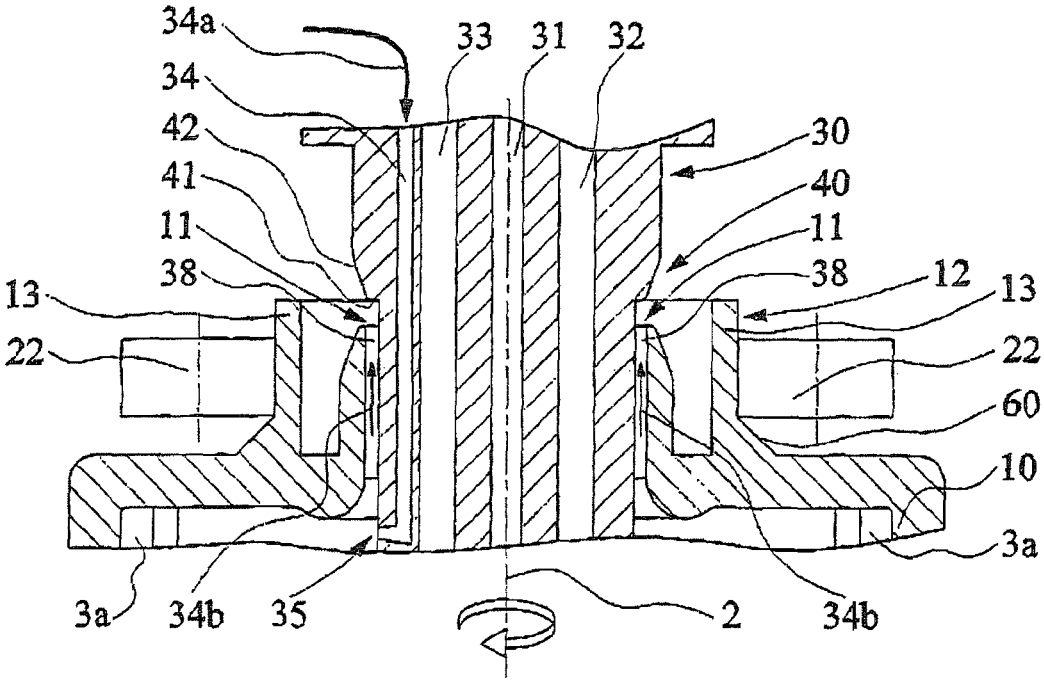
FIG. 2*a* is a detail of a variant of the illustration given in FIG. 2.

According to a second possible embodiment of the opening means, the latter can be composed of a conical portion 60 adjacent to the tread 13. This variant is shown in FIG. 2*a*, which is a detail illustration of the neck 12 in which the guide means 22 are already engaged with the tread 13. In this illustration, the presence of the conical portion 60, preferably a frustoconical portion, will be noted, it being situated just below the tread 13. The function of this opening means according to the second embodiment is as follows.

Figure 4:
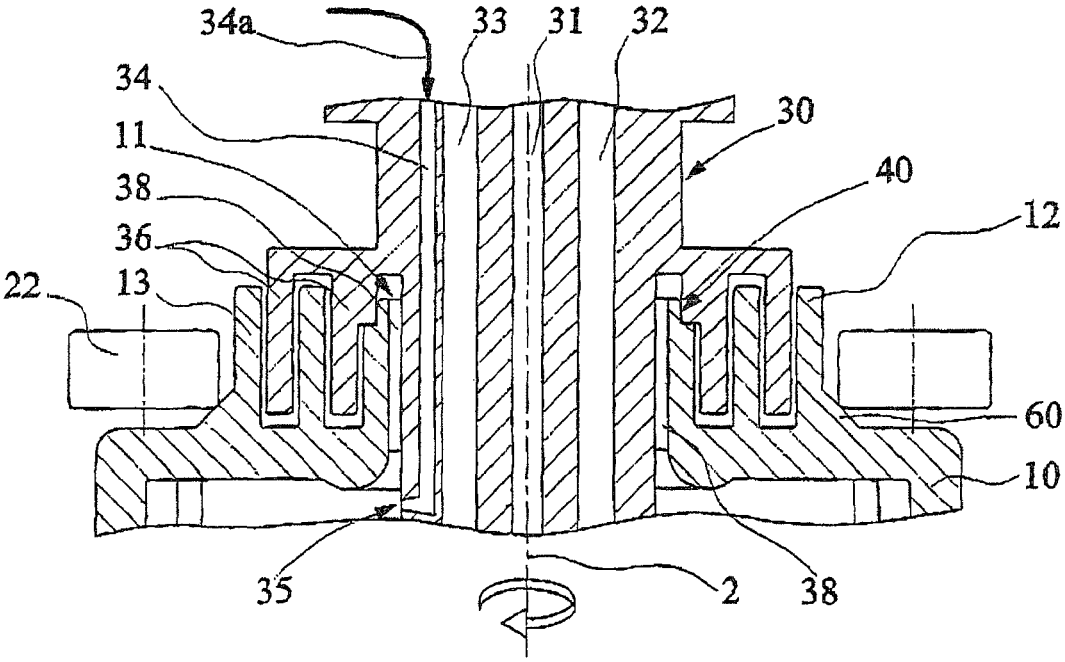
FIG. 4 is a schematic view similar to that of FIG. 2, showing a variant of the device of the present invention, said device being shown in what is called a closed position.

When the centrifugation chamber is positioned between the guide means 22, the gap 38 is initially kept closed, and the guide means 22 are in a retracted position, in such a way as to facilitate insertion of the chamber between them. This configuration is illustrated in FIG. 4 with reference to another variant. In this initial configuration, the chamber is temporarily supported by the static member 30, which is still engaged in the centrifugation chamber and maintained in this position by the closure means 40. In this way, the centrifugation chamber is held in a slightly raised position relative to the guide means 22, as is shown in FIG. 4.

Automatic opening of the gap 38 is obtained by a slight downward sliding of the centrifugation chamber 10 along its axis of revolution 2. This sliding is obtained automatically when the guide means 22 come into engagement with the chamber, in initial contact with the closure means formed by the conical portion 60. The bearing and clamping of the guide means 22 against this conical portion will push the latter downward until the guide means are in engagement with the tread 13, as is illustrated in FIG. 2*a*. As a result of this slight downward sliding of the chamber, the gap 38 will be freed, the lower part 4 of the chamber will be able to engage with the shaft 21 of the drive means 20, and the device will soon be ready to operate.

Irrespective of which embodiment is chosen, it will be noted that the opening means 40 also allows the gap 38 to be maintained in its open position, thereby avoiding its inadvertent closure during the entire time needed for the use of the device.

By virtue of the filter 39, the closure means 40 and the possible mutual sliding of the two main parts 30, 10 of the device between two relatively near positions, it is possible for the device of the present invention to be made ready and sterilized, in the closed position, in its packaging and to guarantee the sterility of this device until it is put to use.

In order to control the pressure of the gaseous fluid, provision is also made for the admission channel 34 to be able to be connected to a common member (shown schematically by reference 61 on FIG. 1) for controlling and regulating the pressure inside this channel. Alternatively, this member could be supplemented or replaced by a member for controlling or regulating the flow rate of the gaseous fluid. Advantageously, these control means make it possible to ensure correct operation of the centrifugation chamber, for example by detecting a possible leak that is out of control or an abnormal restriction or even a total obstruction or blockage of the opening 11. It will be noted that the overpressure within the centrifugation chamber can typically be of the order of 0.1 to 100 millibar, such that the main function of the gaseous fluid can be correctly fulfilled.

Figure 3:
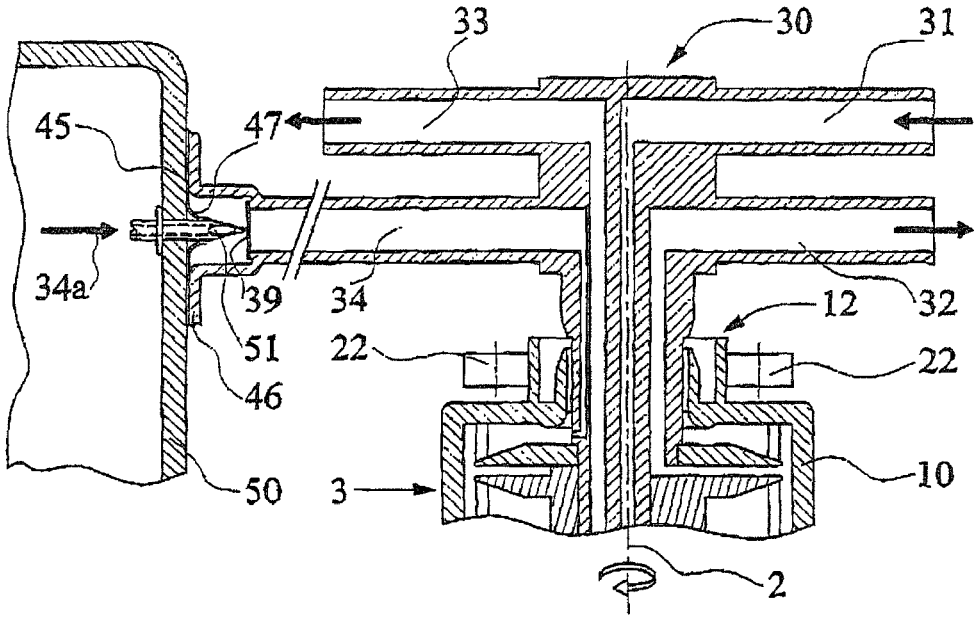
FIG. 3 is a view similar to that of FIG. 1, illustrating the connection between a channel of the device of the present invention and an external machine.

With reference to the schematic illustrations given in FIGS. 1 and 3, it will be noted that the admission channel 34 for the gaseous fluid is terminated upstream by a protective membrane 45 which at least partially closes this channel. Made of a flexible and elastic material, this membrane can be provided in two possible configurations.

According to the first configuration, the protective membrane 45 hermetically closes the admission channel 34 in order to guarantee the sterility of the whole device when it is not yet connected to the source of gaseous fluid for which it is intended. Thus, the protective membrane 45 and the closure device 40 ensure non-contamination of the device of the present invention from the moment it is removed from its sterile package (not shown) and up to the moment when it is connected to the source of gaseous fluid via the admission channel 34. To do this, provision is made for this protective membrane to be pierced through, as will be seen by reference to FIG. 3.

In said FIG. 3, this protective membrane can, if necessary, also be applied to a fitting 46 integrally connected to the upstream end part of the admission channel 34. This is because the device of the present invention can be connected to a machine 50 for treatment of blood fluids. The wall of the machine will comprise, for example, a tubular endpiece 51 for perforating the protective membrane 45. After this membrane has been perforated, the insertion of this circular endpiece through the membrane will bring about a natural deformation of same until it presents an elastic lip 47. This lip will surround the tubular endpiece and fit thereon in order to act as a sealing joint. Such a joint will usefully prevent the gaseous fluid from escaping from the fitting 46. This same machine is equipped with the means necessary to produce or be connected to a source of pressurized gaseous fluid, preferably sterile or pre-sterilized.

According to the second possible configuration of this membrane, it is provided with a circular opening having a diameter smaller than that of the tubular endpiece 51, and, for this reason, it only partially closes the admission channel 34. In this case, the fitting 46 will be made leaktight only after the tubular endpiece has been inserted through the circular opening formed beforehand in this membrane, by virtue of the elastic lip 47 formed by the peripheral part of the circular opening. In the same way, this lip will be automatically placed against the tubular endpiece because of the latter's diameter, which is greater than that of the circular opening formed beforehand in the membrane.

The principal aim of providing this membrane is therefore to ensure leaktightness between the tubular endpiece 51 and the device during operation thereof. It ensures that the gaseous fluid injected into the channel 34*a* does not escape from the device before passing through the centrifugation chamber 10.

Upon connection of the disposable device to the machine 50, the tubular endpiece 51 on the one hand permits piercing of the membrane 45 or widening of its circular opening, and, on the other hand, it serves as a channel for conveying the gaseous fluid into the admission channel 34.

Referring to FIG. 4, this shows a schematic enlargement of the central part of a variant of the device of the present invention. More precisely, this figure shows a detail of a second embodiment of the neck 12 of the centrifugation chamber in which the static member 30 for admission/evacuation is engaged. Said member 30 is illustrated in an initial position, called the closed position, which corresponds for example to the position in which the device is situated when removed from its packaging. In this figure, it will be noted that the escape path of the gaseous fluid from the centrifugation chamber is by way of a gap 38 of sinuous form. The labyrinth shape given to this gap is defined by the provision of baffles 36, which at least partially occupy the space of this gap. These baffles can be integrally connected either to the static member 30 or to the neck 12 of the centrifugation chamber, or some can be connected to the static member 30 and some to this chamber, as is illustrated in FIG. 4.

Advantageously, the provision of these baffles makes it possible, at the same flow rate of gas, to increase the loss of head within the escape path formed by the gap 38. Thus, the overpressure in the centrifugation chamber will be all the greater. Advantageously too, the provision of these baffles can improve the leaktightness of the disposable device, in particular at the place where the static member 30 extends through the neck 12 of the centrifugation chamber. The shape of the gap 38 can be of greater or lesser complexity depending on the number, position and shape of the baffles 36.

According to a preferred embodiment, the components of this device are intended to be produced by injection of a plastic material in a mold. The dimensions of the centrifugation chamber are of the order of 20 to 200 mm in length, for a diameter of between 10 and 100 mm approximately. Moreover, most of the components forming this device are of cylindrical shape, which makes their injection molding easier. The production of such a device by an injection molding procedure is perfectly suited to this type of embodiment by reason of its small dimensions, its disposable nature and the imperatives of limiting the manufacturing costs.

Finally, it will be noted again that the subject matter of the present invention could also be used for the purposes of analyzing blood samples or for carrying out other forms of manipulation of blood, for example washing of the red blood cells, for the purposes of autotransfusion in particular, or for deglycerolization of frozen red blood cells.

The invention claimed is:

1. Disposable device for centrifugation of blood, used for separating or also washing constituents of the blood, and comprising:

a centrifugation chamber with an axis of revolution and with an opening through which the axis extends, wherein said opening is formed in an upper part of said centrifugation chamber, means that guide the rotation of said centrifugation chamber and that are designed to engage with the centrifugation chamber against a tread, means for driving this centrifugation chamber in rotation about its axis of revolution, at least one static member for admission/evacuation which is engaged in said centrifugation chamber via the opening thereof and which comprises at least one inlet channel for said blood and at least one outlet channel for a constituent of said blood, wherein said static member for admission/evacuation comprises at least one admission channel which is provided for a pressurized gaseous fluid and which opens out inside the centrifugation chamber, and a gap is formed in said opening between the centrifugation chamber and the static member for admission/evacuation, in order to allow said gaseous fluid to escape from the centrifugation chamber, wherein the centrifugation chamber and/or the static member for admission/evacuation slides along the axis of revolution between a position in which the gap is closed and a position in which the gap is open.

2. Device according to claim 1, wherein the device comprises a means for hermetic closure of the gap.

3. Device according to claim 2, wherein said closure means is formed by a shoulder and/or a bearing surface that can engage in the opening of said centrifugation chamber.

4. Device according to claim 1, wherein the device comprises a means for automatic opening of the gap.

5. Device according to claim 4, wherein said opening means is formed by the pressure exerted by said gaseous fluid on said closure means.

6. Device according to claim 4, wherein said opening means is formed by a conical portion adjacent to said tread.

7. Device according to claim 1, wherein baffles at least partially occupy the space of the gap.

8. Device according to claim 1, wherein the admission channel for the gaseous fluid is provided with at least one disposable filter for sterilizing the gaseous fluid.

9. Device according to claim 1, wherein a protective membrane at least partially closes the admission channel upstream thereof.

10. Device according to claim 9, wherein said protective membrane allows a tubular endpiece to be inserted into said protective membrane.

11. Device according to claim 10, wherein said protective membrane forms an elastic lip that surrounds the tubular endpiece when the tubular endpiece is passed through the protective membrane.

12. Device according to claim 1, wherein the admission channel for the gaseous fluid is connected to a member for controlling or regulating the pressure prevailing inside this channel and/or to a member for controlling or regulating the flow rate of the gaseous fluid.

13. Disposable device for centrifugation of blood, used for separating or also washing constituents of the blood, and comprising:

a centrifugation chamber with an axis of revolution and with an opening through which the axis extends, wherein said opening is formed in an upper part of said centrifugation chamber, means that guide the rotation of said centrifugation chamber and that are designed to engage with the centrifugation chamber against a tread, means for driving this centrifugation chamber in rotation about its axis of revolution, at least one static member for admission/evacuation which is engaged in said centrifugation chamber via the opening thereof and which comprises at least one inlet channel for said blood and at least one outlet channel for a constituent of said blood, wherein said static member for admission/evacuation comprises at least one admission channel which is provided for a pressurized gaseous fluid and which opens out inside the centrifugation chamber, and a gap is formed in said opening between the centrifugation chamber and the static member for admission/evacuation, in order to allow said gaseous fluid to escape from the centrifugation chamber, and wherein the device comprises a means for hermetic closure of the gap.

14. Device according to claim 13, wherein said closure means is formed by a shoulder and/or a bearing surface that can engage in the opening of said centrifugation chamber.

15. Device according to claim 13, wherein the device comprises a means for automatic opening of the gap.

16. Device according to claim 15, wherein said opening means is formed by the pressure exerted by said gaseous fluid on said closure means.

17. Device according to claim 15, wherein said opening means is formed by a conical portion adjacent to said tread.

18. Disposable device for centrifugation of blood, used for separating or also washing constituents of the blood, and comprising:

a centrifugation chamber with an axis of revolution and with an opening through which the axis extends, wherein said opening is formed in an upper part of said centrifugation chamber, means that guide the rotation of said centrifugation chamber and that are designed to engage with the centrifugation chamber against a tread, means for driving this centrifugation chamber in rotation about its axis of revolution, at least one static member for admission/evacuation which is engaged in said centrifugation chamber via the opening thereof and which comprises at least one inlet channel for said blood and at least one outlet channel for a constituent of said blood, wherein said static member for admission/evacuation comprises at least one admission channel which is provided for a pressurized gaseous fluid and which opens out inside the centrifugation chamber, and a gap is formed in said opening between the centrifugation chamber and the static member for admission/evacuation, in order to allow said gaseous fluid to escape from the centrifugation chamber, and wherein baffles at least partially occupy the space of the gap.

19. Device according to claim 18, wherein the admission channel for the gaseous fluid is provided with at least one disposable filter for sterilizing the gaseous fluid.

20. Disposable device for centrifugation of blood, used for separating or also washing constituents of the blood, and comprising:

a centrifugation chamber with an axis of revolution and with an opening through which the axis extends, wherein said opening is formed in an upper part of said centrifugation chamber, means that guide the rotation of said centrifugation chamber and that are designed to engage with the centrifugation chamber against a tread, means for driving this centrifugation chamber in rotation about its axis of revolution, at least one static member for admission/evacuation which is engaged in said centrifugation chamber via the opening thereof and which comprises at least one inlet channel for said blood and at least one outlet channel for a constituent of said blood, wherein said static member for admission/evacuation comprises at least one admission channel which is provided for a pressurized gaseous fluid and which opens out inside the centrifugation chamber, and a gap is formed in said opening between the centrifugation chamber and the static member for admission/evacuation, in order to allow said gaseous fluid to escape from the centrifugation chamber, wherein a protective membrane at least partially closes the admission channel upstream thereof, wherein said protective membrane allows a tubular endpiece to be inserted into said protective membrane, and wherein said protective membrane forms an elastic lip that surrounds the tubular endpiece when the tubular endpiece is passed through the protective membrane.

21. Device according to claim 20, wherein the admission channel for the gaseous fluid is connected to a member for controlling or regulating the pressure prevailing inside this channel and/or to a member for controlling or regulating the flow rate of the gaseous fluid.

* * * * *